United States Patent [19]

Cave et al.

[11] Patent Number: 4,992,123

[45] Date of Patent: Feb. 12, 1991

[54] METHOD AND APPARATUS FOR INCORPORATING A FILAMENT INTO A PLASTIC CONTAINING SHEET

[75] Inventors: Brian J. Cave, Formby; William B. Holmes, Wallasey, both of England

[73] Assignee: Stork X-Cel, Boxmeer, Netherlands

[21] Appl. No.: 346,740

[22] Filed: May 3, 1989

[30] Foreign Application Priority Data

May 5, 1988 [GB] United Kingdom ..... 8810564

[51] Int. Cl.[5] ..... B29C 65/00; B29C 65/78; B65H 81/00

[52] U.S. Cl. ..... 156/161; 156/177; 156/178; 156/439; 156/547

[58] Field of Search ..... 156/117, 161, 177, 178, 156/397, 439, 440, 547, 552; 28/100, 101, 102; 66/84 A

[56] References Cited

U.S. PATENT DOCUMENTS

| | | | |
|---|---|---|---|
| 3,108,028 | 10/1963 | Sprunck et al. | 156/440 |
| 3,690,990 | 9/1972 | Izumi | 156/439 |
| 4,437,323 | 3/1984 | Hittel et al. | 66/84 A |
| 4,804,436 | 2/1989 | Debroche et al. | 156/117 |
| 4,867,825 | 9/1989 | Gidge | 156/440 |

FOREIGN PATENT DOCUMENTS

| | | | |
|---|---|---|---|
| 0282875 | 4/1966 | Australia | 156/177 |
| 0523494 | 4/1956 | Canada | 156/440 |
| 16356 | 2/1980 | European Pat. Off. . | |
| 2174743 | 10/1973 | France . | |
| 586298 | 3/1977 | Switzerland . | |

*Primary Examiner*—Michael W. Ball
*Assistant Examiner*—Steven D. Maki
*Attorney, Agent, or Firm*—Staas & Halsey

[57] ABSTRACT

A method and apparatus for laying down a weft filament. The weft yarns are propelled over a moving substrate, whereupon they are clamped and pulled down into the substrate. The apparatus propels the filaments through an elongate hollow chamber where they are clamped by clamping means. They are then transferred from the chamber onto the substrate. By pivoting the apparatus the angles at which the filaments can be layed onto the substrate can be carefully controlled enabling hitherto unobtainable products to be produced.

11 Claims, 5 Drawing Sheets

METHOD AND APPARATUS FOR INCORPORATING A FILAMENT INTO A PLASTIC CONTAINING SHEET

BACKGROUND OF THE INVENTION

The present invention relates to a method and apparatus for laying a filament, and in particular, but not exclusively, to a method and apparatus for laying a weft yarn onto a substrate on which the weft yarn is to be secured.

One application where it is necessary to lay a weft yarn onto a substrate occurs in the manufacture of reinforced plastics sheeting, the plastics sheeting being reinforced with a first set of fibres arranged perpendicularly to a second set of fibres.

The known method for producing such a reinforced sheet is to first apply the plastics to a paper backing sheet withdrawn from a storage roll, the plastics being applied in liquid form, usually in the form of a solution. Reinforcing weft fibres are then laid across the width of the backing paper onto the liquid plastics, and are embedded therein. This is conventionally done by means of a travelling head which traverses across the width of the backing sheet and which lays down a weft yarn which sinks into, and becomes embedded in, the liquid plastics. By traversing backwards and forwards, a series of weft yarns is produced. However, in order to position the yarns perpendicularly to the direction of motion of the travel of the backing sheet, it is necessary for the travelling head to traverse at a precisely calculated angle to the direction of motion of the paper, otherwise the threads will not be perpendicular to the length of the finished product. Also, this process is necessarily slow since in order to obtain reasonable accuracy the travelling head must not travel too quickly. It is possible to speed up the process by having a plurality of travelling heads, each dispensing its own weft yarn, but the cost of such apparatus is significantly increased. Moreover, the problem with all such travelling heads is that the resultant yarn laid down onto the plastics is not particularly accurate, in that the spacings between adjacent weft yarns can vary by several millimeters, perhaps as much as 5 mm in either direction from the correct location. This does not cause too much of a problem when the spacing of adjacent weft yarns is intended to be relatively large, but if the spacing of adjacent weft yarns becomes smaller, then the error involved in using the above apparatus becomes significant.

Once the weft yarns are laid onto the plastics, a series of parallel, equally- spaced warp yarns extending parallel to the direction of motion of the backing paper, are laid down on top of the weft yarns and onto the plastics, in which they become embedded. The construction is subsequently passed through various further treatments and drying stages to produce the finished product.

As stated above, in order to achieve reasonable speed, it is necessary to have a plurality of dispensing heads, and even so the accuracy obtained with the prior art devices is not good.

SUMMARY OF THE INVENTION

It is an object of the present invention to provide an apparatus and method for laying a filament onto a substrate, which will enable the filament to be applied rapidly and accurately.

In accordance with a first aspect of the present invention, an apparatus for laying a filament onto a substrate comprises compressed gas projection means for projecting the filament across the substrate, an elongate hollow chamber spaced from the substrate into which the filament is projected, the chamber having a closeable elongate aperture along its length, means for opening and closing the elongate aperture, clamping means situated adjacent each end of the elongate chamber for clamping the projected filament when in the closed chamber, and displacement means for displacing the clamped filament through the opened elongate aperture of the chamber onto the substrate.

Such an apparatus allows rapid laying of the filament by virtue of the compressed gas projection means, and the filament is laid accurately by virtue of the fact that it is clamped in position and then displaced into engagement with the substrate.

Preferably, the apparatus further comprises severing means for severing the filament to be laid down from the supply of filament.

In a preferred embodiment, the clamping means and/or the displacement means are adapted to apply a tension to the clamped filament before application onto the substrate.

The clamping means and the displacement means may comprise a movable clamping head which is movable into abutment with a clamping base, to clamp the filament therebetween. Preferably, the clamping base is movable, against the force of a resiliently deformable member, such that the clamped filament may be moved towards the substrate through the opened aperture in the elongate hollow chamber.

There may be a plurality of apparatuses in accordance with the first aspect of the present invention, arranged to apply filaments consecutively to a substrate.

The or each apparatus may be movable, for example pivotally mounted, which enables filaments to be applied to the substrate at different angles.

In a preferred embodiment, the aperture in the elongate hollow chamber may be opened and closed by means of a movable, preferably flexible flap. The flap may be resiliently deformable and may be integrally formed with the elongate hollow chamber.

In accordance with a second aspect of the present invention, a method of laying a filament onto a substrate comprises projecting the filament through an elongate hollow chamber spaced apart from the substrate, clamping the filament above the substrate when inside the chamber and displacing the clamped filament through an opened elongate, closeable aperture in the hollow member onto the substrate.

Preferably, the filament is projected by means of compressed gas. Also, in a preferred embodiment, a tension is applied to the clamped filament before it is displaced onto the substrate.

In accordance with a third aspect of the present invention, a method of applying one or more filaments onto a moving sheet comprises passing the moving sheet over a roller or other direction-changing device and laying the or each filament onto the sheet at, or in the vicinity of, the direction-changing device, the angle of inclination of the or each filament to be layed onto the sheet with respect to the portion of the sheet upstream of the direction-changing device being less than the angle through which the direction of the sheet is changed.

BRIEF DESCRIPTION OF THE DRAWINGS

By way of example only, specific embodiments of the present invention will now be described, with reference to the accompanying drawings, in which:

FIG. 7 is a diagrammatic cross-sectional side elevation of the apparatus for laying of the warp filaments, in accordance with the present invention; and FIGS. 8(*a*) to 8(*e*) are diagrammatic views of some filament patterns which may be produced by means of the present invention.

DESCRIPTION OF THE PREFERRED EMBODIMENTS

Figure 1:
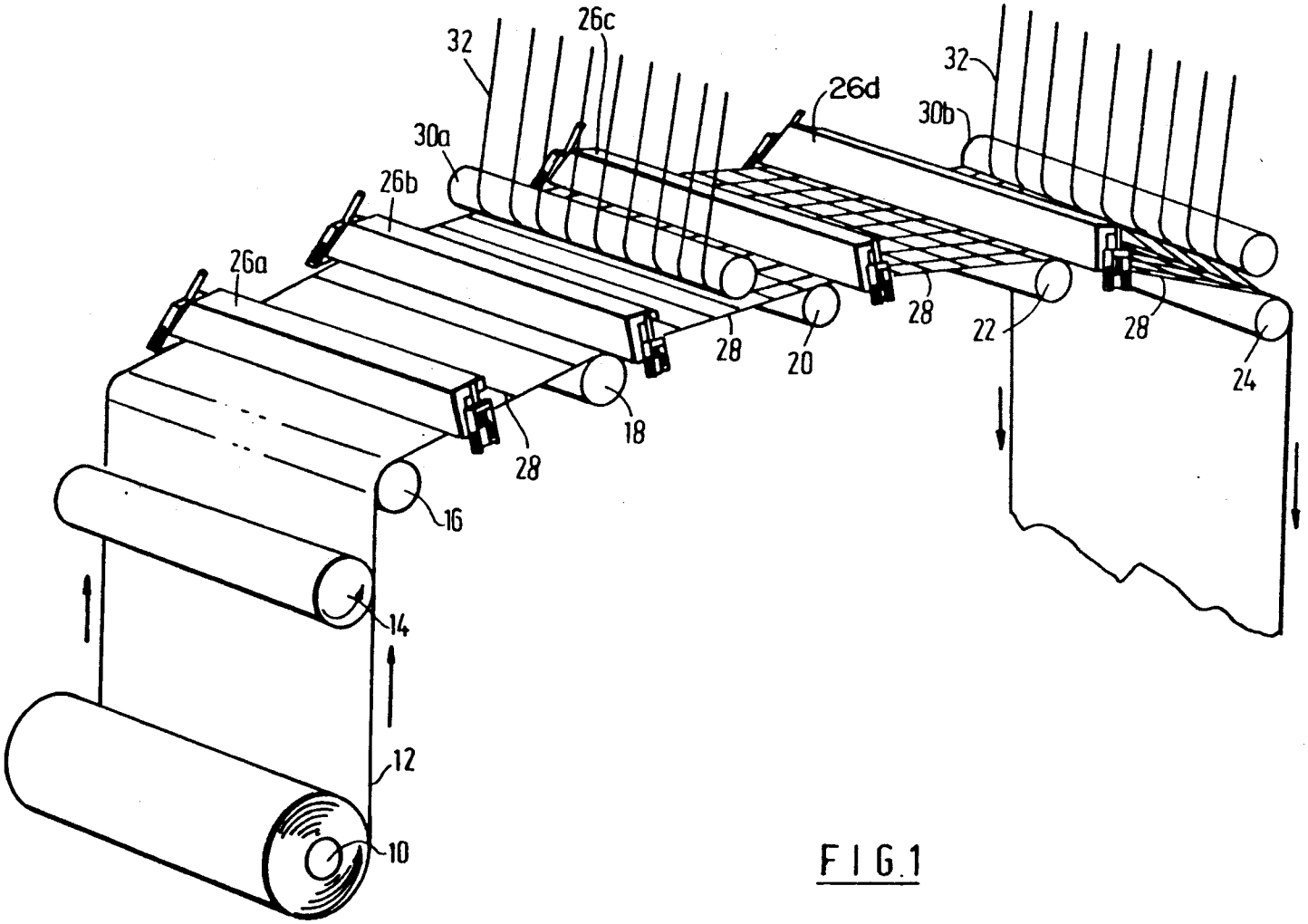
FIG. 1 is a diagrammatic perspective view of an apparatus for laying intersecting fibres onto a continuously fed liquid-plastics substrate.
Figure 2:
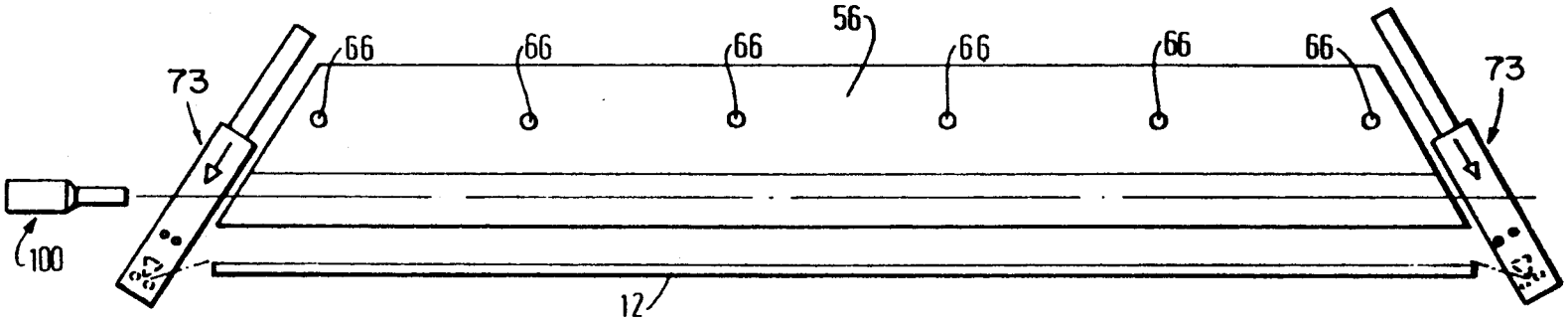
FIG. 2 is a front elevation of a device in accordance with the present invention used to lay filaments across the substrate.

Referring firstly to FIG. 1, there is illustrated an apparatus for forming a plastics sheet reinforced with filaments extending along and across the sheet. The apparatus comprises a dispensing roller 10 from which a continuous sheet of backing paper 12 is dispensed. One surface of the backing paper 12 is coated with a liquid plastics coating, in the form of plastics dissolved in a solvent, by means of an application roller 14. The coated backing paper then passes over a first direction-changing roller 16 and over four further direction-changing rollers 18, 20, 22, 24. In between each pair of adjacent direction-changing rollers is situated a device 26*a* to 26*d*, illustrated schematically in FIG. 1, for laying down a filament 28 across the coated backing paper onto the liquid plastics coating, the filament extending in a direction substantially perpendicular to the direction of motion of the coated backing paper 12.

In between the second and third, 26*b* and 26*c*, and after the fourth, 26*d*, transverse filament laying devices are situated warp filament laying rollers 30*a*, 30*b* respectively. Each of the rollers 30*a*, 30*b* is adapted to guide a plurality of longitudinal warp filaments 32 to lie in a direction substantially parallel to the direction of motion of the coated backing paper 12.

As best seen in FIG. 8, the rollers are arranged to divert the direction of motion of the coated backing paper 12. In particular, the middle roller 20 and the final roller 24 are adapted to divert the plane of the paper through angles $x_1$ and $x_2$, respectively (FIG. 1). It can also be seen that the longitudinal or warp threads 32 define angles $y_1$ and $y_2$, such that $y_1 < x_1$ and $y_2 < x_2$. In this way, as the warp threads are laid onto the coated substrate, they are pressed firmly into the substrate at the rollers 20, 24 respectively.

The device for applying the transverse filaments is shown in more detail in FIGS. 2 to 6. The device comprises a metal base 34 comprising a planar upper section 36 and a planar lower section 38 extending perpendicularly to the upper section 36. An elongate flexible plenum member 40, made out of, for example, Neoprene (Trade Mark) projects beyond the end of the planar member 38, and is secured thereto by means of an angled bracket 42 which is received in a recess 46 of the plenum member 40 and is secured to the planar member 38 by means of a bolt 44. One end of the bracket 42 fits into an elongate groove in the flexible elongate plenum member 40.

The plenum member 40 comprises an upper, solid portion 48 from which a relatively rigid flap 50 depends downwardly. The opposite side of the plenum member is provided with a thinner flap 52, defining an elongate plenum chamber 54, which is bulbous in cross-section, therebetween. The plenum member 40 naturally assumes the shape illustrated in FIG. 4, but can be constrained to assume the shape illustrated in FIG. 3 by means of a flap moving plate 56 which engages in an elongate groove 58 defined by an elongate rib 60 on the outer face of the flap 52. The flap actuating member 56 is angled, such that its upper portion lies generally parallel to the plane of the upper planar portion 36 of the base. The upper edge of the flap actuating plate 52 is seated in an elongate V-shaped groove 62 in the planar portion 38 of the base. The flap actuating plate 56 is pivotable about the groove 62 by means of six push rods 64, secured to the plate by means of bolts 66, the opposite ends of which push rods are each connected to a respective U-shaped bracket 68. A cam follower 70 is pivotally mounted between the free ends of each bracket 68, and abuts against a cam 72, as will be explained. Each of the brackets 68 is provided with two elongate apertures 74, one in each face of the U-shaped bracket, to allow movement relative to the cam shaft 76. By rotating the cam shaft, the cam followers engage with the cam and move the push rods and the flap actuating plate 56. The natural resilience of the flexible material forming the flap 52 removes the need for a separate spring.

Situated at each end of the plenum member 40 is a filament gripping device 73, which are both connected to the base 34. Each filament gripping device comprises two opposed, parallel plates 75 interconnected at one end by means of a metal block 77 and at the other end by means of a metal rod 78. A pneumatic cylinder or ram 80 passes through an aperture 82 in the block 77 and is secured therein. A piston rod 84 extends from the ram 80 and has an elongate metal head 86 of generally triangular cross-section secured thereto. Upon extension of the ram 80, the head 86 is adapted to engage between two parallel rods 88, the rods being secured between each of two metal brackets 90. The brackets are constrained, by virtue of elongate apertures 92 in the plates 75, to move in a direction parallel to the direction of motion of the head 86, and the brackets 90 and the rods 88 are biassed to lie in the position shown in FIG. 6 with the brackets engaging the edge of the apertures 92 nearest the pneumatic arm 80, by virtue of two helical tension springs 94 extending between a respective bracket 90 and the metal block 77. A third plate 96 extends between two long edges of the plates 75, and in use is situated adjacent the associated filament laying devices 26*a*, 26*b*, 26*c*, 26*d*. The plate 96 is provided with a cut-out 98 having a bulbous portion smoothly merging into an elongate aperture.

The filament gripping device is adapted to grip a filament which passes through the lobed portion of the aperture in the plate 96 by extending the ram 80 so that the filament is trapped between the head 86 and the two rods 88. Further extension of the ram 80 causes the filament to be pulled downwardly through the elongate portion of the aperture 98 against the force of the tension springs 94.

In use, each filament gripping device 73 is mounted with the direction of motion of the ram 80 inclined to the elongate axis of the plenum member 40, the filament gripping devices at opposite ends of the plenum member being inclined in opposite directions. Also, the apparatus includes a conventional filament air gun 100, such as those used in conventional air weaving looms, which is adapted to project a filament 102 along the elongate plenum chamber 54. The passage of the filament 102 is aided by a plurality of jets 104 (of which two are shown in the drawings) which extends into the plenum chamber 54. The apparatus also includes a filament cutter 106 comprising a fixed blade 108 and a moving blade 110, the cutter being conventional and known to those skilled in the art.

Figure 3:
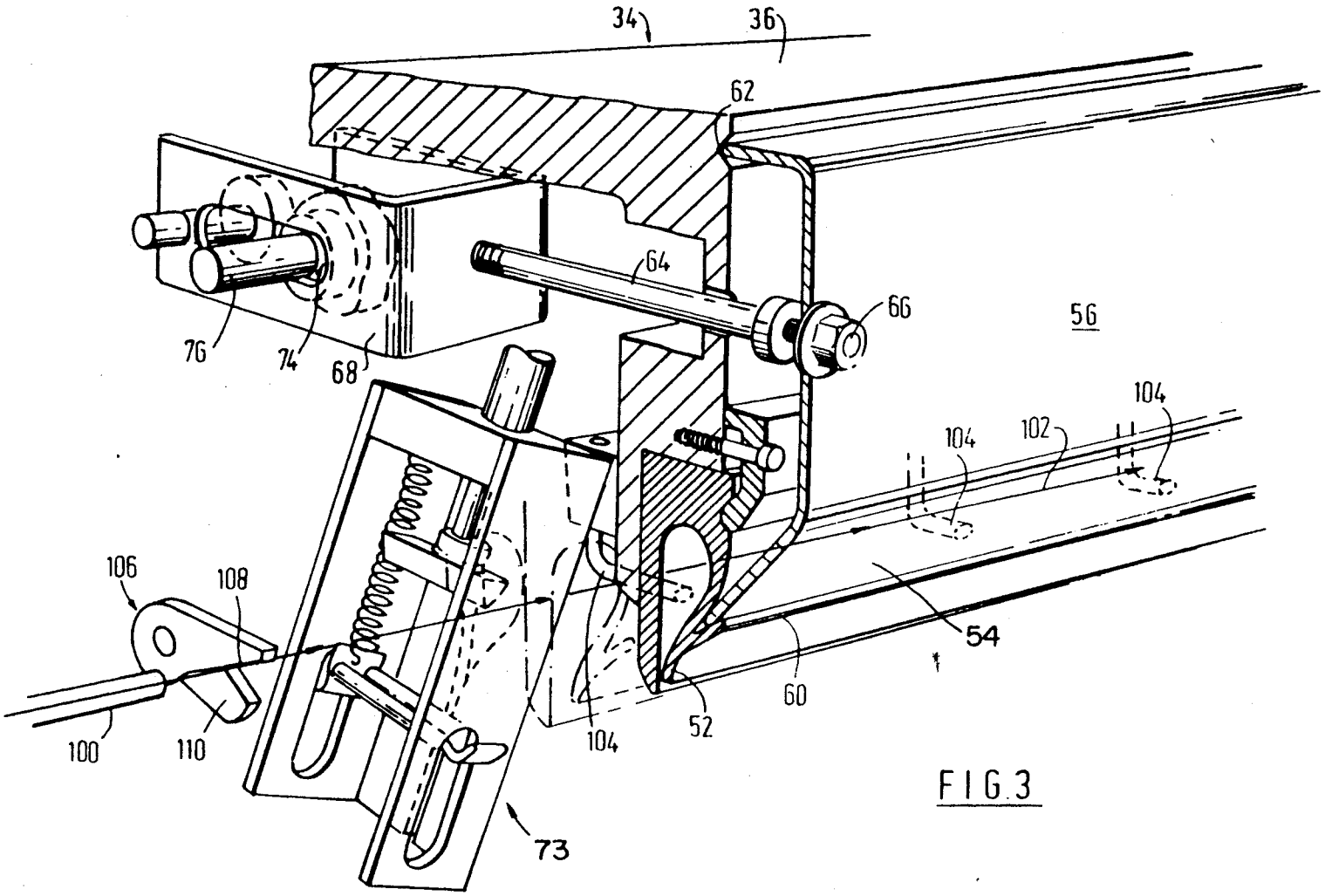
FIG. 3 is a perspective view, partly cutaway, of one end of the device shown in FIG. 2, in a first, closed position.
Figure 4:
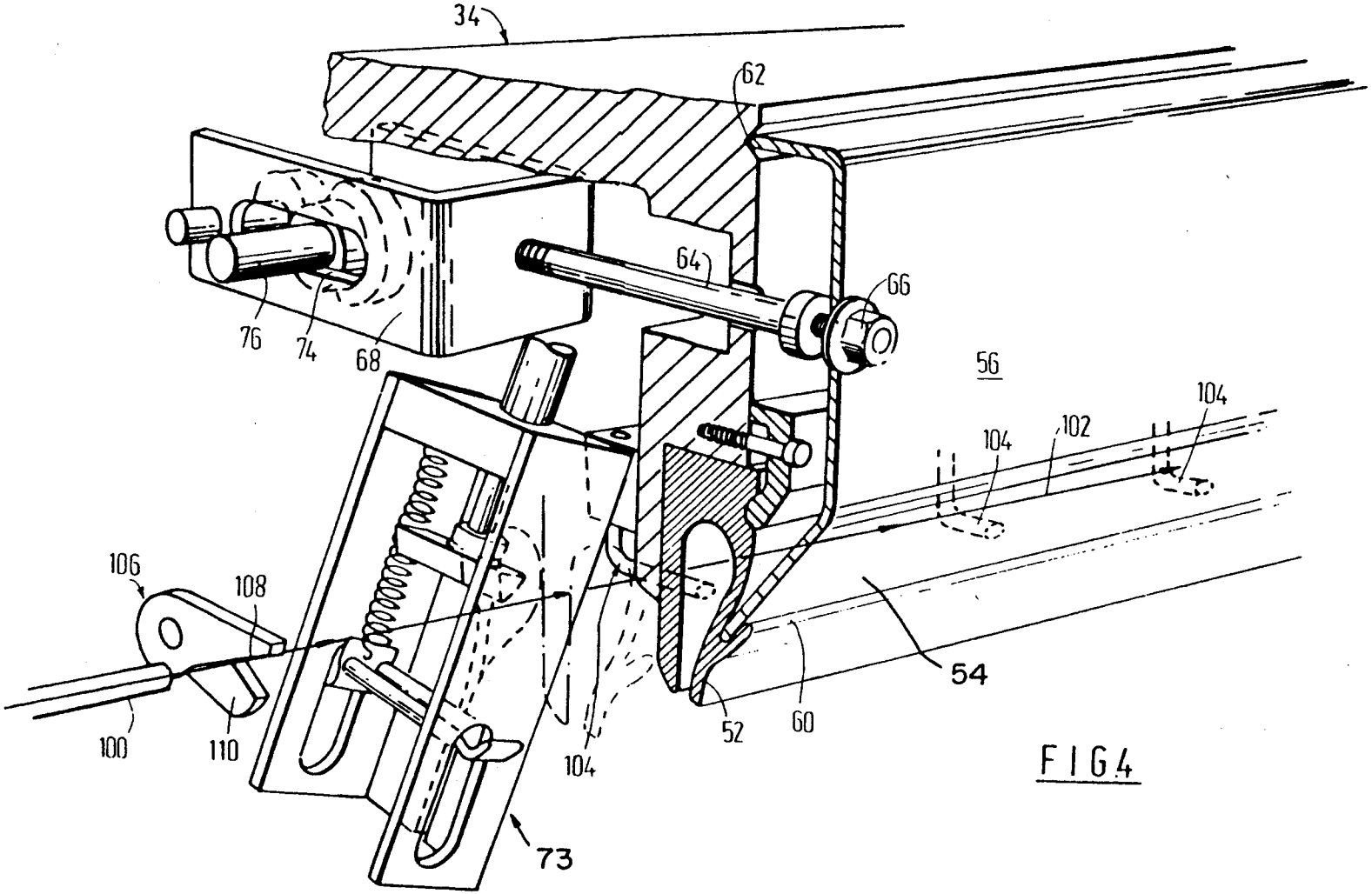
FIG. 4 is a perspective view, partly cutaway, of one end of the device shown in FIG. 2, in the open position.
Figure 5:
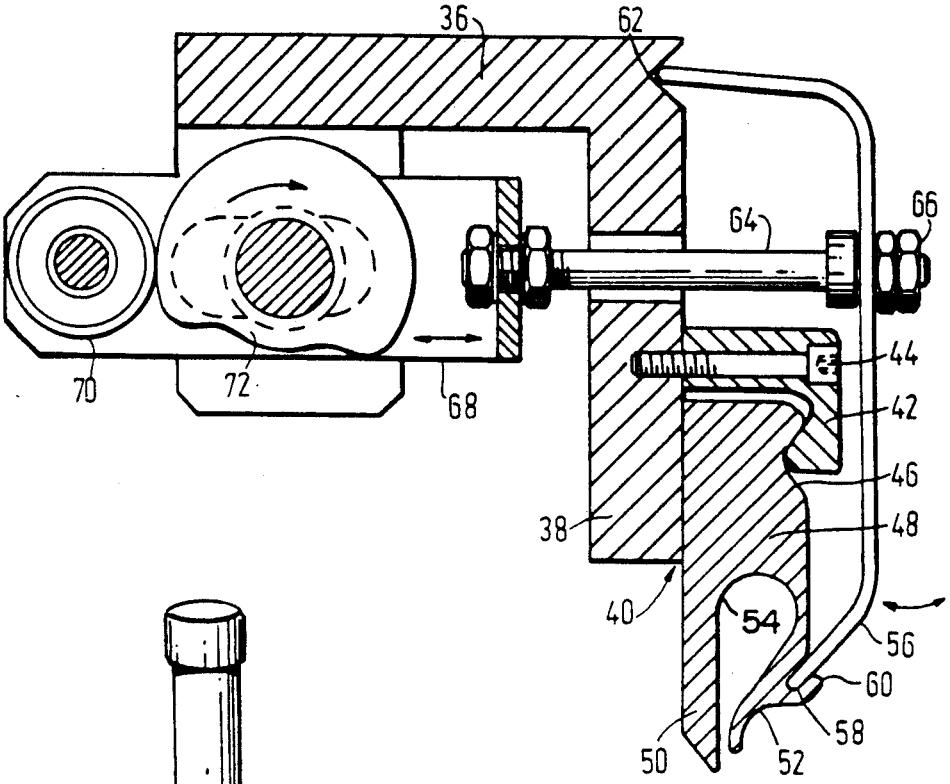
FIG. 5 is a cross-sectional side elevation of the device of FIG. 2.
Figure 6:
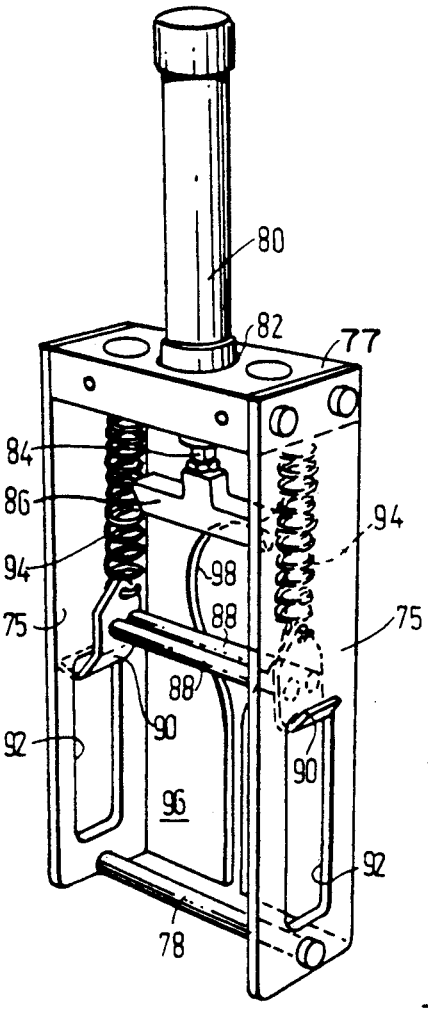
FIG. 6 is a perspective detail view of one portion of the device of FIG. 2.

In use, the liquid plastics solution is applied to the sheet of backing paper 12 by means of the roller 14. The coated sheet then passes over roller 16 whereupon it encounters the first transverse filament applying device 26*a*. At predetermined intervals, the air gun 100 shoots a fixed length of filament 102 through the bulbous portion of the aperture in the adjacent filament gripping device 73 and into the elongate plenum chamber 54. The air gun gives a single blast of air but a fixed length of filament is always shot from the air gun since the filament is dispensed from a filament accumulator which only allows a certain length of filament to be dispensed. The passage of the filament through the plenum chamber is aided by the plurality of jets 104 which aids the passage of the filament and also helps to reduce turbulence in the chamber. The filament is thus rapidly projected into the plenum chamber and extends out of the both ends thereof. The cutter 106 is then operated to sever the filament, and the two filament gripping devices 73 are immediately operated after the severing has taken place. It should be noted that in this position, the plenum member is in a closed position, as illustrated in FIG. 3. Immediately after the cutter has severed the filament, the pneumatic rams 80 are actuated to trap opposite ends of the filament between the heads 86 of triangular cross-section and the two movable parallel bars 88. As soon as the filaments are gripped, the flap actuating plate 56 is pivoted by means of the push rods 64, due to rotation of the cams 72, and the flap 52 is thereby pivoted away from the relatively rigid base portion 50, forming an elongate aperture along the whole length of the plenum member 40. The continued motion of the pneumatic rams 80 then causes the filament to be moved downwardly, and into contact with the liquid plastics situated on the surface of the backing paper 12. It will also be noted that due to the inclination of the gripping devices 74, the filament is placed under tension as it is laid onto the plastics. This produces a very straight clamped filament and allows the filament to be positioned accurately on the liquid plastics. Moreover, the tensioning of the filament reduces the tendency for the filament to "balloon".

As seen in FIG. 1, consecutive transverse filament laying devices are positioned to lay transverse filaments, one after the other. In between certain pairs of the devices, longitudinal or warp threads are applied to the coated surface of the backing paper 12 by passing a plurality of parallel filaments over a roller 20 and laying the filaments onto the plastics surface, as seen in FIG. 7. As mentioned previously, this is done at a direction-changing roller 20 over which the sheet of backing paper passes, and the angle of inclination $y_1$ of the threads $w_1$ to the portion of the sheet upstream of the roller 20 is less than the change in angle $x_1$ of the upstream and downstream portions, so that the threads are firmly pressed under tension into the liquid plastics. Two further transverse filament laying devices 26*c*, 26*d* and one warp thread laying roller 24 (similar to roller 20, with angle $y_2$ less than angle $x_2$) are subsequently provided to lay down further reinforcing filaments. When all the filaments have been applied, the sheet is advanced for further processing to cure the liquid plastics.

By using the apparatus and method of the present invention, filament patterns such as those illustrated in FIG. 8(*a*) and 8(*b*) may be produced, by appropriate timing of the application of the filaments and appropriate relative movement between the substrate (the plastic coated paper backing sheet) and the transverse filament laying apparatus. However, by mounting the transverse filament laying apparatus movable, for example by arranging for it to pivot about its centrepoint, the filament patterns shown in FIGS. 8(*c*), 8(*d*) and 8(*e*) may be produced. These are only examples of filament patterns which may be produced, and it will be appreciated that many other different patterns of filaments may be produced with the apparatus and method of the present invention. The ability to produce different filament patterns allows the properties of the finished sheet to be accurately predetermined, and a sheet may be given predetermined properties by applying an appropriate reinforcing filament pattern thereto.

Indeed, although FIGS. 8(*c*) to 8(*e*) are shown as having a warp yarn, this may be dispensed with, and all the filaments may be laid down by using a movable, e.g. a pivotable apparatus in accordance with the present invention.

The invention is not restricted to the details of the foregoing embodiment. In particular, there may be a plurality of transverse filament laying apparatus arranged one after the other, as illustrated schematically in FIG. 7, which lay down filaments consecutively.

I claim:

1. An apparatus for incorporating a filament into a plastics containing sheet, which apparatus comprises:

(a) a compressed gas projecting means for projecting a filament across said plastics containing sheet, (b) an elongate hollow chamber, which chamber is spaced apart from said plastics containing sheet and into which chamber said filament is projected, said chamber having a closeable elongate aperture along its length, (c) clamping means situated adjacent each end of said elongate chamber, whereby said filament can be clamped when inside said chamber, and can then be displaced through the opened elongate aperture of the chamber into said plastics containing sheet.

2. The apparatus according to claim 1, which further comprises severing means.

3. The apparatus according to claim 1, in which the clamping means are adapted to apply a tension to the clamped filament.

4. The apparatus according to claim 1, wherein each clamping means is inclined to the vertical and wherein the clamping means are symmetrically arranged about a central axis of the elongate hollow chamber.

5. The apparatus according to claim 1, further comprising jet means within the elongate chamber, which is capable of facilitating passage of the filament through the elongate chamber.

6. The apparatus according to claim 1, wherein each clamping means comprises a movable clamping head and is adapted to apply tension to the clamped filament.

7. The apparatus according to claim 1, comprising a flexible flap which can be used for opening and closing the elongate aperture.

8. A method of incorporating a filament into a plastics containing sheet, comprising the steps of:

(a) projecting said filament through an elongate hollow chamber spaced apart from said plastics containing sheet, which chamber includes a closeable elongate aperture along its length, wherein the aperture is closed, (b) clamping said filament, inside the chamber above the plastics containing sheet, while the aperture is still closed, and (c) opening said elongate closeable aperture and displacing therethrough said filament such that said filament comes into contact with said plastics containing sheet.

9. The method according to claim 8, further comprising the substep of projecting said filament using compressed gas.

10. The method according to claim 8, further comprising the substep of applying a tension to the clamped filament before incorporating the filament into said plastics containing sheet.

11. The method according to claim 8, wherein said plastics containing sheet is a reinforced plastics sheet.

* * * * *